US007857012B2

(12) United States Patent
Speich et al.

(10) Patent No.: US 7,857,012 B2
(45) Date of Patent: Dec. 28, 2010

(54) METHOD AND NEEDLE WEBBING LOOM IN ORDER TO WEAVE A RIBBON

(75) Inventors: Francisco Speich, Gipf-Oberfrick (CH); Anton Probst, Frick (CH)

(73) Assignee: Textilma AG (CH)

( * ) Notice: Subject to any disclaimer, the term of this patent is extended or adjusted under 35 U.S.C. 154(b) by 107 days.

(21) Appl. No.: 11/992,641

(22) PCT Filed: Sep. 12, 2006

(86) PCT No.: PCT/CH2006/000489

§ 371 (c)(1),
(2), (4) Date: Mar. 25, 2008

(87) PCT Pub. No.: WO2007/038883

PCT Pub. Date: Apr. 12, 2007

(65) Prior Publication Data

US 2009/0145508 A1 Jun. 11, 2009

(30) Foreign Application Priority Data

Oct. 6, 2005 (CH) ..... 1615/05

(51) Int. Cl.
*D03D 47/44* (2006.01)
*D03D 35/00* (2006.01)
*D03D 47/08* (2006.01)
*D03D 41/00* (2006.01)

(52) U.S. Cl. ..... 139/11; 139/22; 139/116.1

(58) Field of Classification Search ..... 139/11, 139/22, 116.1, 431, 446, 447, 449, 450, 454
See application file for complete search history.

(56) References Cited

U.S. PATENT DOCUMENTS

| | | | | | |
|---|---|---|---|---|---|
| 2,532,087 | A | * | 11/1950 | Clutsom | 139/431 |
| 3,411,549 | A | | 11/1968 | Muller | |
| 4,007,763 | A | | 2/1977 | Sellers et al. | |
| 4,298,033 | A | * | 11/1981 | Takahashi et al. | 139/450 |
| 4,421,142 | A | * | 12/1983 | Muller | 139/117 |
| 4,541,461 | A | * | 9/1985 | Villa | 139/442 |
| 5,299,603 | A | | 4/1994 | Reiter | |
| 5,564,477 | A | * | 10/1996 | Probst | 139/442 |
| 5,878,787 | A | * | 3/1999 | Speich | 139/22 |
| 5,954,098 | A | * | 9/1999 | Speich | 139/431 |
| 6,112,775 | A | | 9/2000 | Hossli | |
| 7,066,214 | B2 | * | 6/2006 | Speich et al. | 139/442 |
| 7,380,573 | B2 | * | 6/2008 | Reiter | 139/447 |
| 7,451,787 | B2 | * | 11/2008 | Speich | 139/22 |
| 2003/0160732 | A1 | | 8/2003 | Van Heerden et al. | |
| 2004/0188531 | A1 | | 9/2004 | Gengel et al. | |

FOREIGN PATENT DOCUMENTS

| | | | |
|---|---|---|---|
| CH | 433 141 | | 9/1967 |
| CH | 663 629 | A | 12/1987 |
| DE | 2400101 | A | 7/1974 |
| DE | 25 12617 | A | 10/1975 |
| DE | 2624 140 | A1 | 12/1976 |
| DE | 30 47 894 | A1 | 7/1982 |
| DE | 4009455 | A | 9/1991 |
| EP | 0 121 648 | A1 | 10/1984 |
| EP | 0 579938 | A2 | 1/1994 |
| EP | 0650539 | A | 5/1995 |
| EP | 0 905 657 | A1 | 3/1999 |
| FR | 2214 772 | A1 | 8/1974 |
| GB | 1424301 | A | 2/1976 |
| GB | 1506597 | A | 4/1978 |
| GB | 2146665 | A | 4/1985 |
| WO | WO 94/26964 | A | 11/1994 |
| WO | WO 00/20672 | A | 4/2000 |

* cited by examiner

*Primary Examiner*—Bobby H Muromoto, Jr.
(74) *Attorney, Agent, or Firm*—George Pappas

(57) ABSTRACT

A needle webbing machine which comprises two weft needles (2*a*, 2*b*) which work simultaneously and in opposite directions on both ribbon sides, in addition to knitting needles (28*a*, 28*b*) which are arranged on both ribbon sides. A yarn lifter (18*a*, 18*b*) which works individually and which is used to advance a weft thread (4*a*, 4*b*) to a weft needle (2*a*, 2*b*), which is open, is provided on each side of the ribbon in order to improve the production thereof.

9 Claims, 7 Drawing Sheets

METHOD AND NEEDLE WEBBING LOOM IN ORDER TO WEAVE A RIBBON

This application claims priority of PCT application PCT/CH2006/000489 having a priority date of Oct. 6, 2005, the disclosure of which is incorporated herein by reference.

TECHNICAL FIELD

The invention relates to a method for weaving a ribbon on a needle ribbon weaving machine and to a needle ribbon weaving machine.

BACKGROUND OF THE INVENTION

A method and a needle ribbon weaving machine for weaving a ribbon of the type initially mentioned are known from DE 40 09 455A. The method described there for producing a ribbon on a needle ribbon weaving machine takes place by means of two closed weft needles operating contradirectionally, the ribbon being woven by both weft needles as a result of insertion into a common shed. The heads of the contradirectionally inserted weft thread loops are secured on each ribbon side by means of wales which are formed in each case from an auxiliary thread and which are located at the two edges of the ribbon. The disadvantage, then, is that always two weft thread loops have to be inserted into a common shed, so that, in the event of a shed change, two weft thread loops, that is to say four weft thread portions, have to be tied in simultaneously. The stability of the ribbon to be produced is impaired as a result. There are also no variations of any kind possible, since closed weft needles having guide loops on which a weft thread is always arranged are used.

SUMMARY OF THE INVENTION

The object of the invention is to improve the method for weaving a ribbon on a needle ribbon machine having two simultaneously and contradirectionally operating weft needles.

Since only that weft which is presented to one of the two weft needles is inserted, any desired weft sequence is possible. Not just two weft threads may be introduced simultaneously into the shed, as is afforded in the prior art, but, in particular, the weft threads may be inserted alternately from ribbon sides to ribbon sides, so that, in the event of each shed change, only one weft thread loop is inserted. Furthermore, it is possible, moreover, to present weft threads even of changing color and quality to the weft needles. This not only affords a mechanically improved quality of the ribbon produced, but the pattern possibility is also increased.

On each ribbon side, the weft thread loops may be knitted together with themselves, or, they may be knitted by means of an interlaced auxiliary thread.

For the needle ribbon weaving machine serving for carrying out the method, it is essential that an individually operating thread lifter for presenting a weft thread to a weft needle designed to be open is present on each ribbon side.

A preferred design of the weft needle which has a fork, arranged on the needle shank, for receiving the weft thread, and also a guide slot for the weft thread, said guide slot running along the needle shank to just short of the fork.

BRIEF DESCRIPTION OF THE DRAWINGS

Exemplary embodiments of the invention are described in more detail below by means of the drawings showing the weaving region of a needle ribbon weaving machine in various weaving phases, specifically the tie-off of an inserted weft thread loop by means of an auxiliary thread in FIGS. 1 to 4 and the tie-off of inserted weft thread loops without an auxiliary thread in FIGS. 5 to 7. In the drawings.

DETAILED DESCRIPTION OF THE PREFERRED EMBODIMENTS

Figure 1:
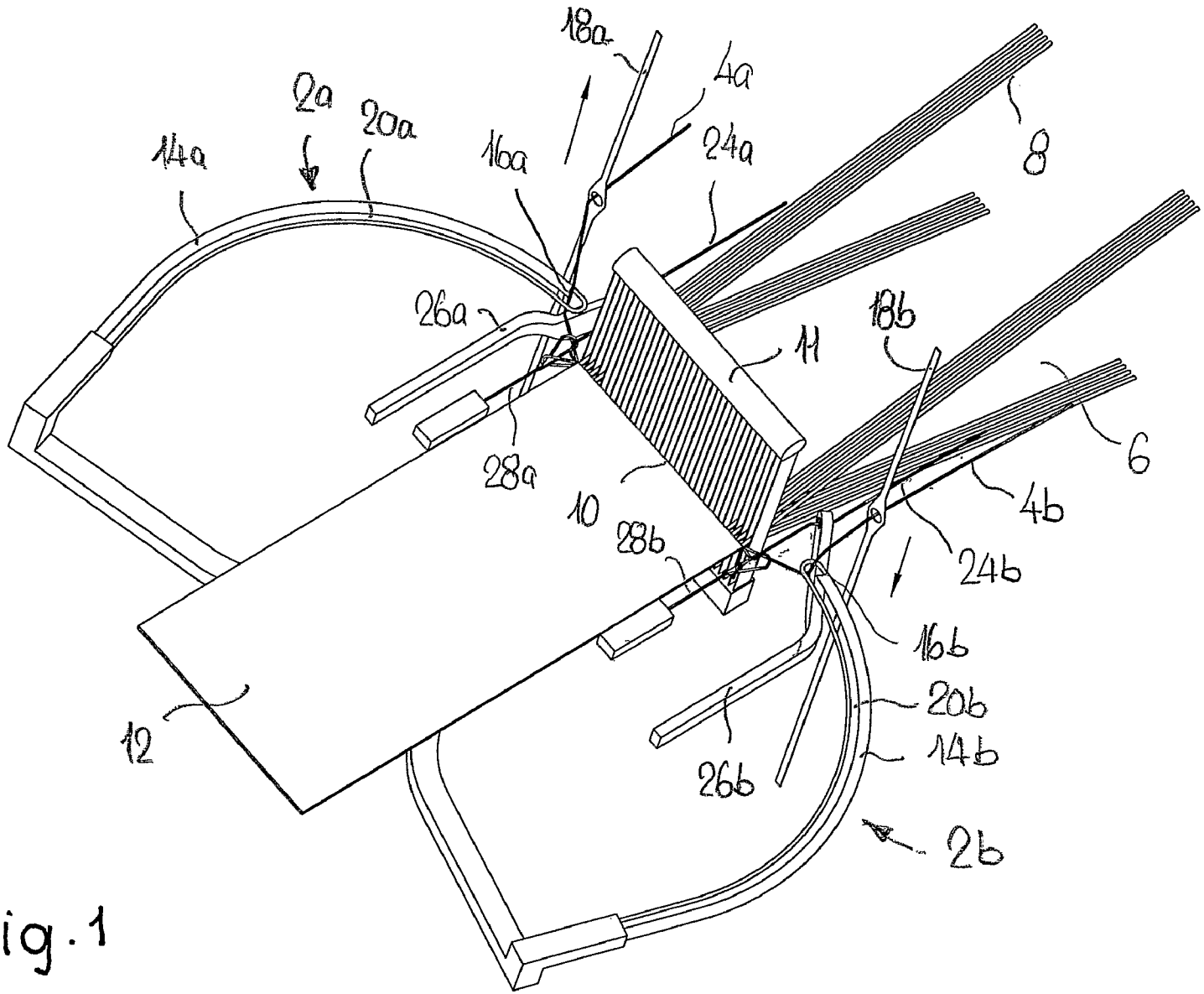
FIG. 1 shows the weaving region during the beating-up of a weft thread loop inserted by the left weft needle in a diagrammatic illustration.

FIGS. 1 to 4 show the weaving region of a needle ribbon weaving machine with two contradirectionally driven weft needles 2*a*, 2*b* which insert weft threads 4*a*, 4*b* into a shed 6. In the shed 6 formed from warp threads 8, the weft threads are beaten up at the beating-up edge 10 by means of a reed 9, thus giving rise to the ribbon 12.

The weft needles 2*a*, 2*b* are in each case open needles, i.e. they have at the front end of a needle shank 14*a*, 14*b* a fork 16*a*, 16*b*, into which the respective weft thread 4*a*, 4*b* is introduced by means of a thread lifter 18*a*, 18*b* movable up and down. The weft needles 2*a*, 2*b* contain in each case guide slots 20*a*, 20*b* which run along the needle shank 14*a*, 14*b* and which reach beyond the forks 16*a*, 16*b*. The guide slots 20*a*, 20*b* serve for guiding the weft thread 4*a*, 4*b* when the weft thread is not inserted into the shed 6, and for making it easier to introduce into the fork 16*a*, 16*b* with the aid of the respective thread lifter 18*a*, 18*b*. The web thread loop 22*a*, 22*b* inserted in each case is secured by means of an auxiliary thread 24*a*, 24*b* which is in each case presented to knitting needles 28*a*, 28*b* by means of a thread guide 26*a*, 26*b* such that said auxiliary thread is interlaced with the weft thread loops 22*a*, 22*b*.

Figure 2:
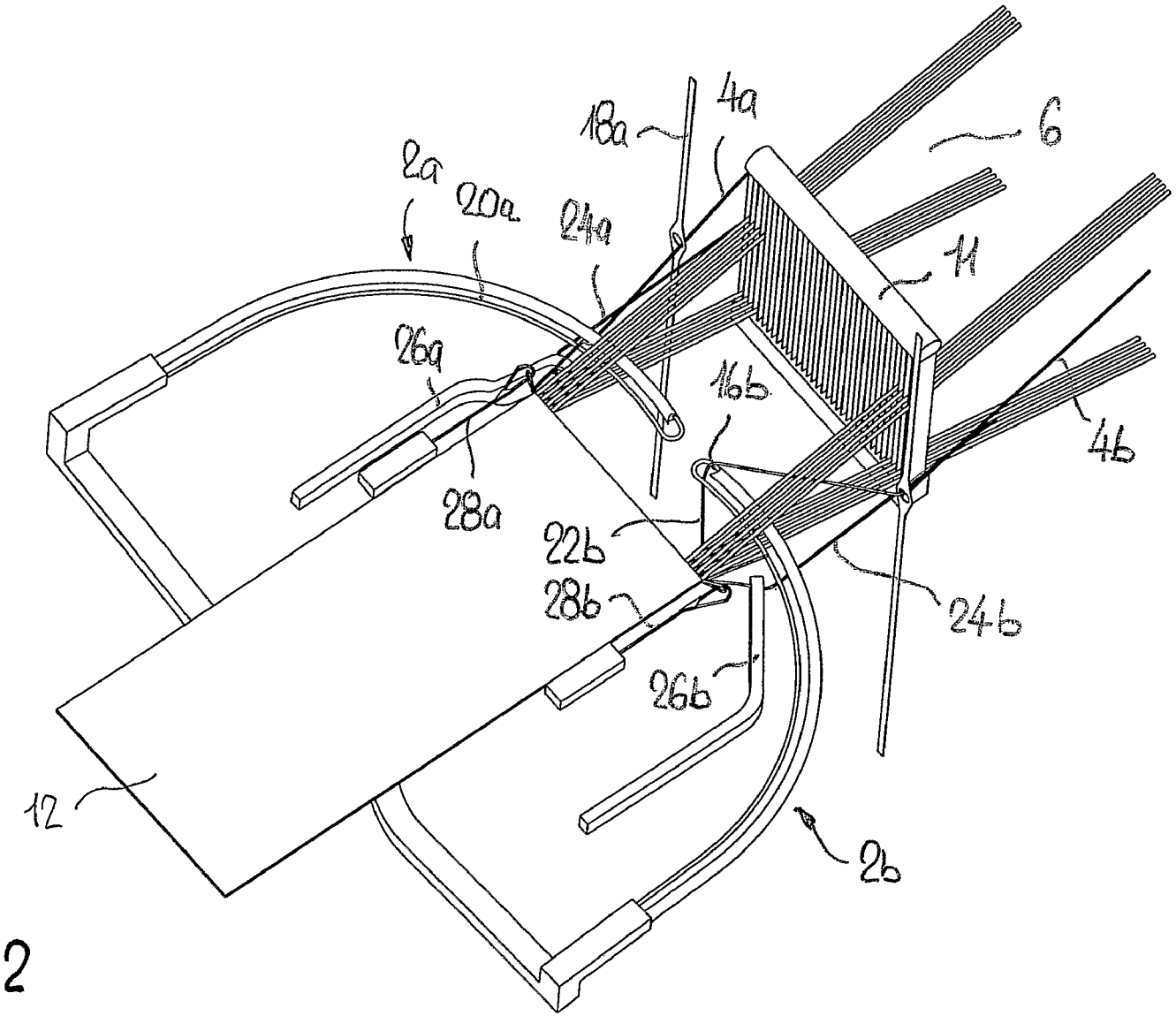
FIG. 2 shows the weaving region of FIG. 1 during the insertion of a weft thread loop by means of the right weft needle.
Figure 3:
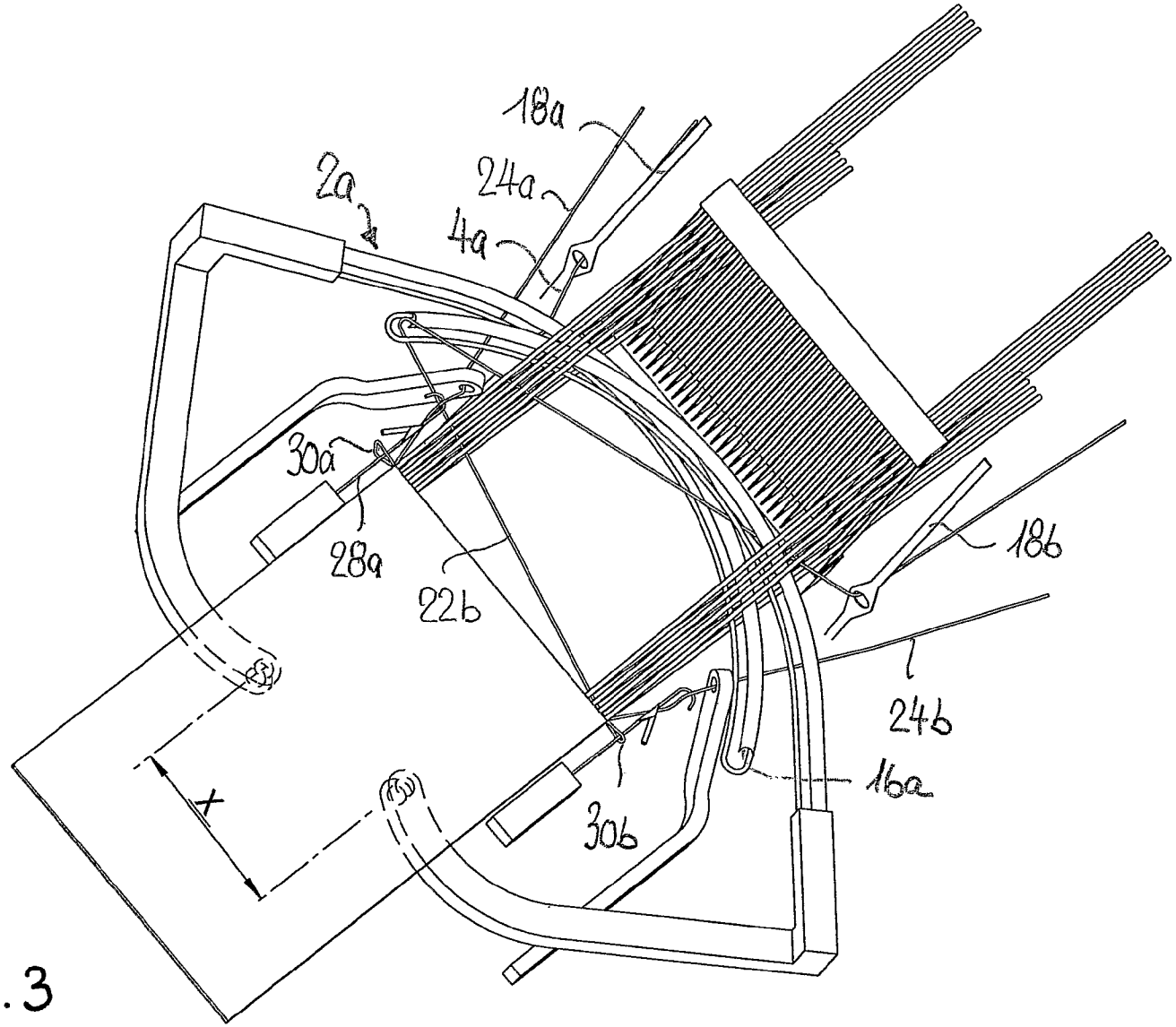
FIG. 3 shows the weaving region of FIG. 2 with an inserted weft thread loop and before the tie-off of the latter.
Figure 4:
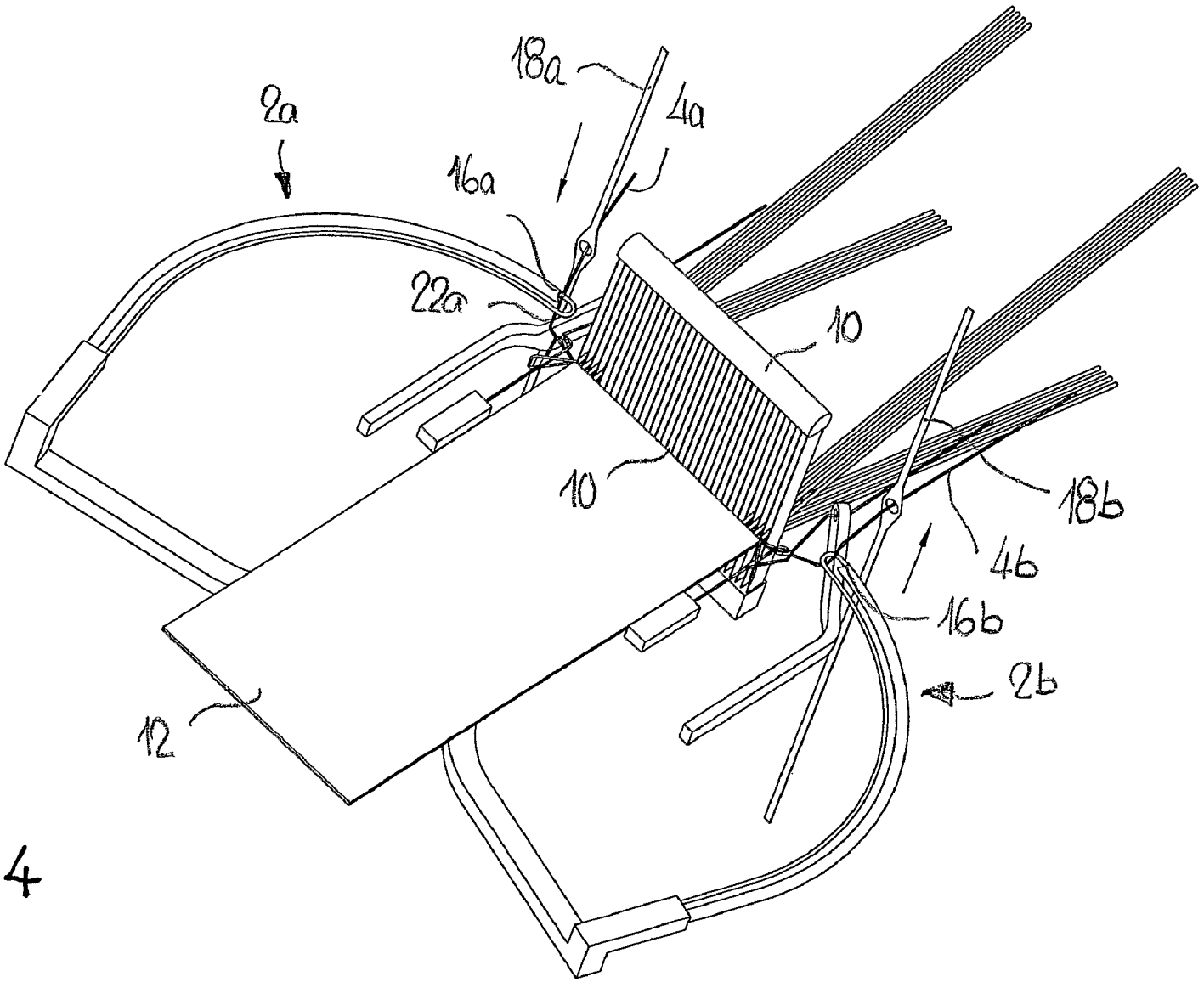
FIG. 4 shows the weaving region of FIG. 3 during the beating-up of the weft thread loop inserted by the right weft needle and during the presentation of the weft thread to the left weft needle.

In the position shown in FIG. 1, the left weft needle 2*a* has just inserted a weft thread loop 22*a* into the shed 6 and has been beaten up at the beating-up edge 10 by means of the reed 11. By means of the left thread lifter 18*a*, the left weft thread 4*a* is raised on the fork 16*a* of the weft needle 2*a* as a result of the raising of the thread lifter 18*a*, to an extent such that said left weft thread cannot be grasped by the fork 16*a* of the weft needle 2*a*. On the right side of the shed, the thread lifter 18*b* is lowered and brings the weft thread 4*b* into engagement on the fork 16*b* of the weft needle 2*b*, so that, the latter can insert the weft thread loop 22*b* into the open shed 6, as shown in FIG. 2. The left weft needle 2*a* runs, empty, into the shed, the weft thread 4*a* being guided in the guide slot 20*a*. When the weft thread loop 22*b* has been inserted completely into the shed, as is evident from FIG. 3, the left knitting needle 28*a* grasps the auxiliary thread 24*a* and draws the latter through the inserted weft thread loop 22*b* and further on through the last loop 30*a* of the auxiliary thread 24*a*. On the right side, the auxiliary thread 24*b* is interlaced with itself, that is to say with its last loop 30*b*, without being drawn through a weft thread loop. After this securing of the inserted weft thread loop 22*b* by means of the auxiliary thread 24*a*, the weft needles 2*a*, 2*b* leave the shed, and the reed 11 beats up the weft thread loop thus inserted at the beating-up edge 10. The thread lifter 18*b* is then raised again and prevents an engagement of the weft thread 4*b* on the fork 16*b* of the weft needle 2*b*. Instead, by means of the thread lifter 18*a*, the weft thread 4*a* is brought into engagement on the fork 16*a* of the weft needle 2*a*, in order, during the next shed opening, to insert a further weft thread loop 22*a* from the left ribbon side in a similar way.

Figure 5:
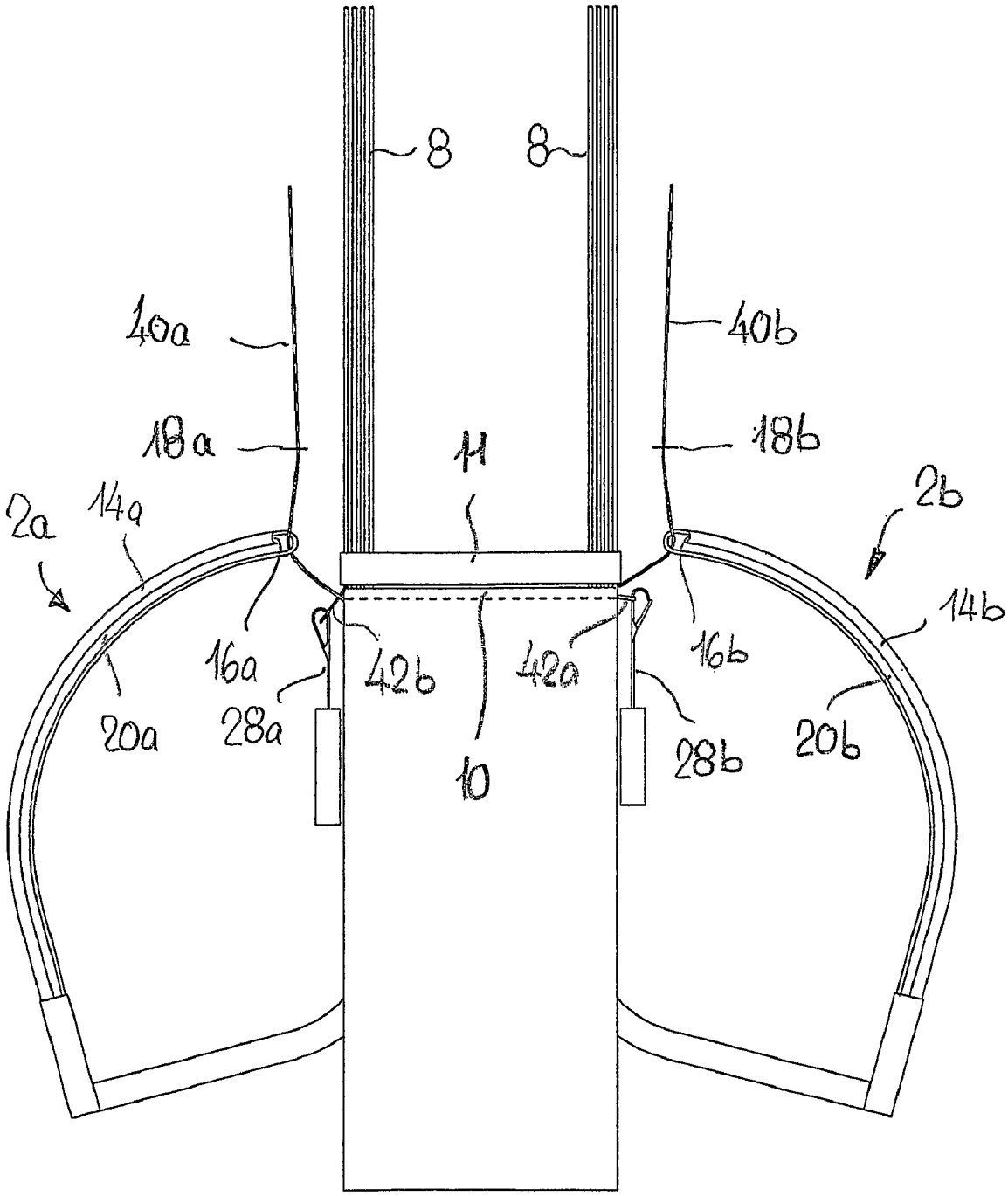
FIG. 5 shows the weaving region during the beating-up of a weft thread loop inserted by the right weft needle.
Figure 6:
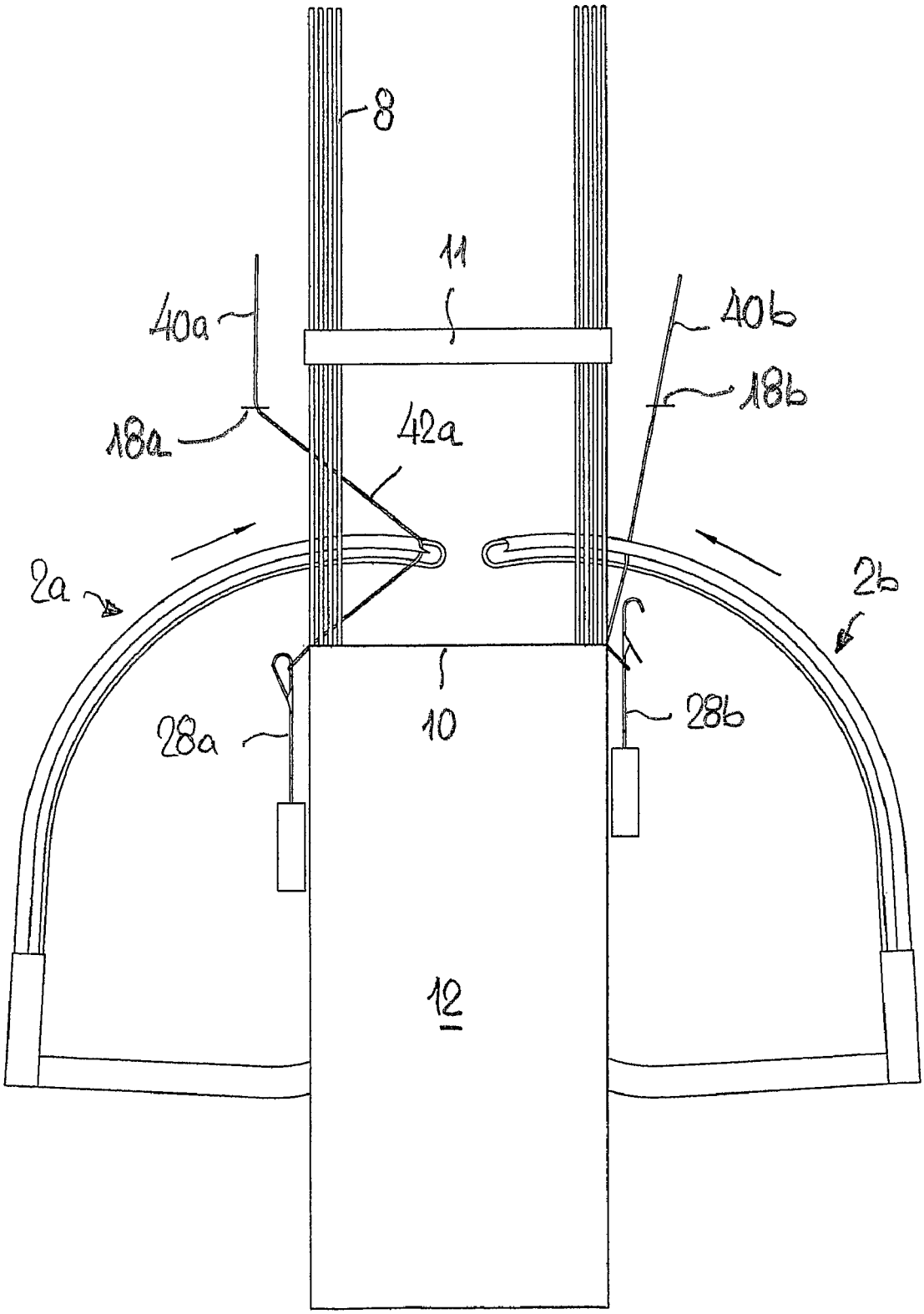
FIG. 6 shows the weaving region of FIG. 5 during the insertion of a weft thread loop inserted by the left weft needle.
Figure 7:
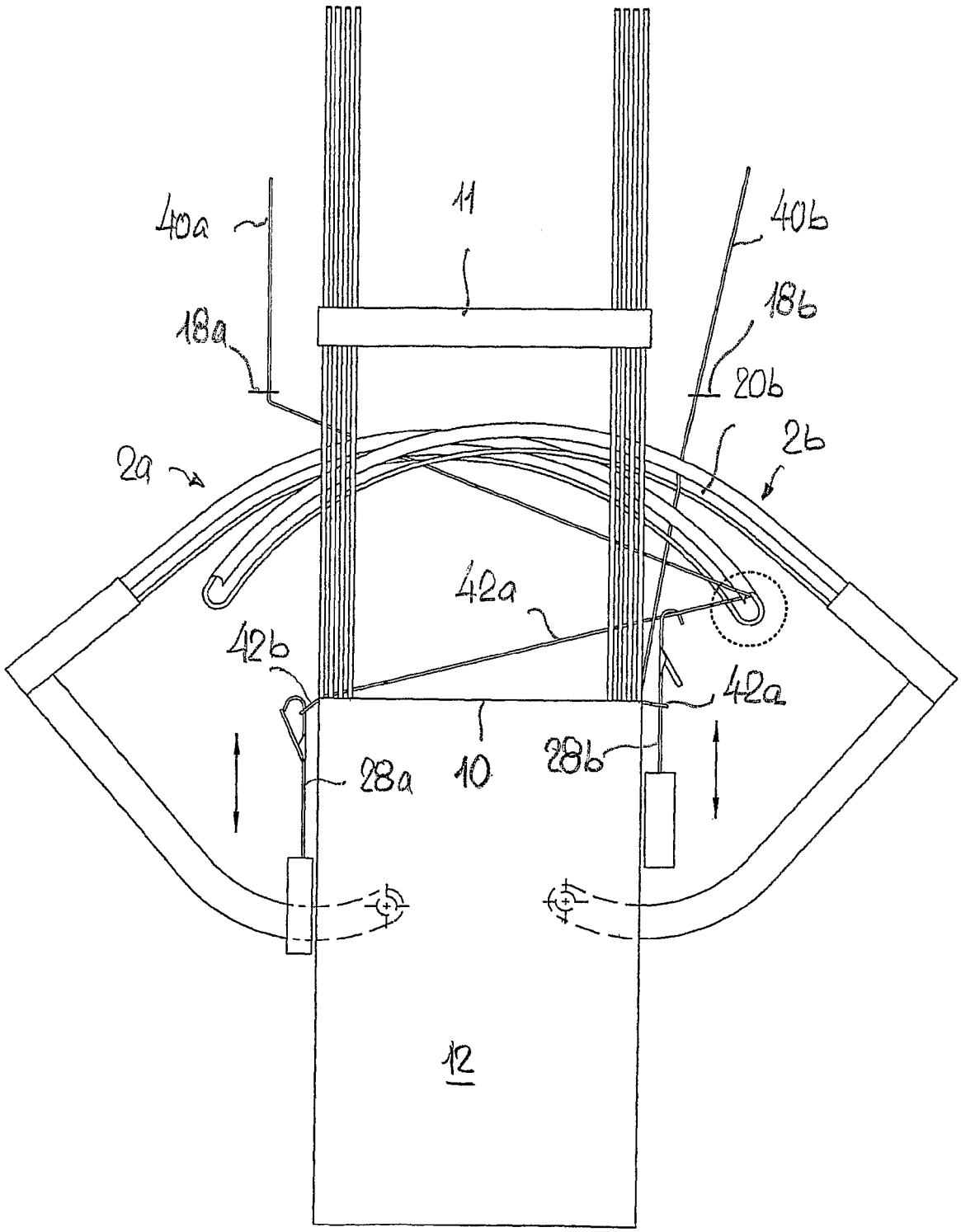
FIG. 7 shows the weaving region of FIG. 6 during the interlacing of the inserted weft thread loop.

FIGS. 5 to 7 show a needle ribbon weaving machine which is constructed similarly to the needle ribbon weaving machine of FIGS. 1 to 4, and therefore parts identical to the first exemplary embodiment are given the same reference symbols. Reference is made to the relevant statements with regard to FIGS. 1 to 4. In the exemplary embodiment of FIGS. 5 to 7, however, no auxiliary threads are used, but, instead, the weft threads 40*a*, 40*b* are interlaced with themselves. FIG. 6 shows how the weft thread loop 42*a* from the weft thread 40*a* is inserted into the shed by means of the left weft needle 2*a*. After complete insertion, the right knitting needle 28*b* grasps the inserted weft thread loop 42*a* and draws the latter through the already knocked-over weft thread loop 42*a*. During the insertion of the weft thread loop 42*a* by means of the weft needle 2*a* from the left side of the ribbon, the right weft needle 2*b* moves, empty, through the shed. The weft thread 40*b* is in this case guided in the guide slot 20*b* of the right weft needle 2*b*, as may be gathered from FIG. 7. As soon as the weft needles 2*a*, 2*b* are drawn back out of the shed, the beating-up of the inserted weft thread loop 42*a* by means of the reed 11 at the beating-up edge 10 takes place, as illustrated in FIG. 5. The shed change is followed by the insertion of the weft thread loop on the right side of the ribbon, the operation taking place in a similar way to the insertion of the weft thread on the left ribbon side.

LIST OF REFERENCE SYMBOLS

2*a* Weft needle
2*b* Weft needle
4*a* Weft thread
4*b* Weft thread
6 Shed
8 Warp thread
10 Beating-up edge
11 Reed
12 Ribbon
14*a* Needle shank
14*b* Needle shank
16*a* Fork
16*b* Fork
18*a* Thread lifter
18*b* Thread lifter
20*a* Guide slot
20*b* Guide slot
22*a* Weft thread loop
22*b* Weft thread loop
24*a* Auxiliary thread
24*b* Auxiliary thread
26*a* Thread guide
26*b* Thread guide
28*a* Knitting needle
28*b* Knitting needle
40*a* Weft thread
40*b* Weft thread
42*a* Weft thread loop
42*b* Weft thread loop

The invention claimed is:

1. A needle ribbon weaving machine comprising two weft needles operating simultaneously and contradirectionally from both ribbon sides wherein only that weft thread which is presented to one of the two weft needles is inserted, so that any desired weft sequence is possible and with knitting needles arranged on both ribbon sides, characterized in that an individually operating thread lifter for presenting a weft thread to a weft needle is present on each ribbon side; wherein each of the thread lifters and weft needles are separately operable members and each of the weft needles include a laterally open, thread engaging front end wherein weft threads are selectively engageable and disengageable with the front ends of the weft needles.

2. The needle ribbon weaving machine as claimed in claim 1, characterized in that each of the weft needles define a fork, each of the forks forming the laterally open, thread engaging front end of the weft needle and being arranged on a needle shank, and wherein each weft needle further includes a guide slot for the weft thread, said guide slot running along the needle shank to just short of the fork.

3. A needle ribbon weaving machine as claimed in claim 1 wherein the weft threads are inserted alternately from ribbon side to ribbon side.

4. A needle ribbon weaving machine as claimed in claim 1 wherein, on each ribbon side, the weft thread loops are knitted together with themselves.

5. A needle ribbon weaving machine as claimed in claim 1 wherein the weft thread loops are tied off by means of an interlaced auxiliary thread.

6. The needle ribbon weaving machine as claimed in claim 3, characterized in that each of the weft needles define a fork, each of the forks forming the laterally open, thread engaging front end of the weft needle and being arranged on a needle shank, and wherein each weft needle further includes a guide slot for the weft thread, said guide slot running along the needle shank to just short of the fork.

7. The needle ribbon weaving machine as claimed in claim 4, characterized in that each of the weft needles define a fork, each of the forks forming the laterally open, thread engaging front end of the weft needle and being arranged on a needle shank, and wherein each weft needle further includes a guide slot for the weft thread, said guide slot running along the needle shank to just short of the fork.

8. The needle ribbon weaving machine as claimed in claim 5, characterized in that each of the weft needles define a fork, each of the forks forming the laterally open, thread engaging front end of the weft needle and being arranged on a needle shank, and wherein each weft needle further includes a guide slot for the weft thread, said guide slot running along the needle shank to just short of the fork.

9. The needle ribbon weaving machine as claimed in claim 1 wherein each of the weft needles are simultaneously inserted into the shed during each operating cycle and wherein each of the weft needles are selectively insertable into the shed in an empty condition without an engaged thread.

* * * * *